US006473579B1

(12) United States Patent
Suzuki et al.

(10) Patent No.: US 6,473,579 B1
(45) Date of Patent: Oct. 29, 2002

(54) SHEET CONVEYING APPARATUS AND IMAGE FORMING APPARATUS PROVIDED THEREWITH

(75) Inventors: Kenji Suzuki, Mishima; Seiichiro Kameda, Odawara, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/696,001

(22) Filed: Oct. 26, 2000

(30) Foreign Application Priority Data

Oct. 29, 1999 (JP) ..... 11-308982
Oct. 18, 2000 (JP) ..... 2000-317723

(51) Int. Cl.[7] ..... G03G 15/00; B65H 29/00

(52) U.S. Cl. ..... 399/124; 271/184; 271/225; 271/902; 399/397; 399/405

(58) Field of Search ..... 399/407, 397, 399/405, 124; 271/225, 184, 185, 902

(56) References Cited

U.S. PATENT DOCUMENTS 4,734,748 A * 3/1988 Murayama et al. ..... 399/124
5,350,166 A 9/1994 Shimizu et al. ..... 271/14
5,625,444 A 4/1997 Suzuki et al. ..... 399/400
5,729,816 A 3/1998 Matsumoto et al. ..... 399/381
6,215,970 B1 * 4/2001 Yoshikawa et al. ..... 399/124
6,314,267 B1 * 11/2001 Kida ..... 399/405

FOREIGN PATENT DOCUMENTS

JP 8-48447 * 2/1996

* cited by examiner

*Primary Examiner*—Susan S. Y. Lee
(74) *Attorney, Agent, or Firm*—Fitzpatrick, Cella, Harper & Scinto

(57) ABSTRACT

An image forming apparatus includes a rotor to which torque in a fixed direction is transmitted and a transmitting unit for transmitting torque to the rotor. The transmitting unit is replaceable by a driving unit capable of freely rotating the rotor in both forward and backward directions.

22 Claims, 11 Drawing Sheets

SHEET CONVEYING APPARATUS AND IMAGE FORMING APPARATUS PROVIDED THEREWITH

BACKGROUND OF THE INVENTION

1. Field of the Invention

The present invention relates to a sheet conveying apparatus with which simplification of apparatus expansion operations and reduction of the apparatus costs can be realized and to an image forming apparatus provided therewith.

2. Related Background Art

With the diversification of users' needs, the image forming apparatus in recent years have come to be configured in such a manner that some processing apparatus for performing processing on a variety of functions and sheets of the image forming apparatus can be added thereto according to the request of the users. One of the concrete examples of these apparatus is disclosed in Japanese Patent Application Laid-Open No. 8-48447 (refer to FIGS. 12A and 12B).

As is disclosed in the specification, in a printer 100 as an image forming apparatus, a sheet discharge portion including sheet discharge rollers 300 is formed as a unit and a sheet discharge roller unit 200 is replaced with a predetermined unit (for example, an option unit 400 shown in FIG. 12B) at the time of performing a desired processing such as double side conveyance and face-up sheet discharge, thereby the mechanism of the printer body can be simplified. Further, in regard to the printer body 100 as an image forming apparatus, a small-size printing apparatus body can be configured only by providing means for image formation and for sheet feeding; accordingly, for the uses requiring a basic mechanism alone, a costless apparatus without any extra equipment can be provided.

This means that a system which answers the users' need for performing a certain process can be proposed just by fitting an apparatus for performing a predetermined processing to an apparatus for simply forming images on a sheet.

The image forming apparatus as described above, however, gives rise to problems described below.

In cases where the sheet discharge roller unit 200, which has an ordinary configuration, is replaced by the option unit 400 having sheet roller pairs 300, 350 as shown in FIG. 12B (the sheet discharge roller pair 300 is not shown in the drawing), the sheet discharge roller pair 300 existing in the sheet discharge roller unit 200 is to be replaced together. The sheet discharge roller pair 300 itself is necessary for the option unit 400 and its function to convey sheets is the same even in the sheet discharge roller unit 200.

In the configuration of the image forming apparatus of the prior art, when the user intends to alter the apparatus by adding any desired system thereto, the parts, such as sheet discharge roller pair 300, which do not need to be replaced have to be replaced together with the unit. The cost of the units replaced includes that of the parts which do not have to be replaced in themselves; accordingly, it becomes higher unnecessarily. Thus, the users desiring to alter the system of their apparatus have had to pay for it.

SUMMARY OF THE INVENTION

The present invention is to provide an image forming apparatus which is configured in such a manner that, when its system needs to be altered, the functions needed to be altered alone can be added to/replaced with the original ones, thereby the cost of altering the system can be held down and the alteration of the same can be simplified. The configuration includes a rotor to which torque in the fixed direction is transmitted and transmitting means for transmitting torque to the rotor, and the transmitting means is replaceable with second driving means capable of freely rotating the rotor in both the forward and the backward directions.

DETAILED DESCRIPTION OF THE PREFERRED EMBODIMENTS

A sheet conveying apparatus and an image forming apparatus provided therewith according to the present invention will be described with reference to FIG. 1.

A printer as an image forming apparatus according to the present invention can be altered into two forms: a plain model printer comprising only an image forming apparatus 1; and an option model printer having a processing apparatus 46 (refer to FIG. 11) capable of performing processing such as stapling and punching, a double side unit for reversing a sheet so as to form images on both sides of the sheet, etc. fitted to its frame body.

Although this printer adopts an electrographic method as an image forming method in which toner images are transferred on sheets, the present invention is not intended to be limited to this method, but applicable to an ink jet recording method in which images are formed by discharging ink, a thermal printing method, etc.

Figure 1:
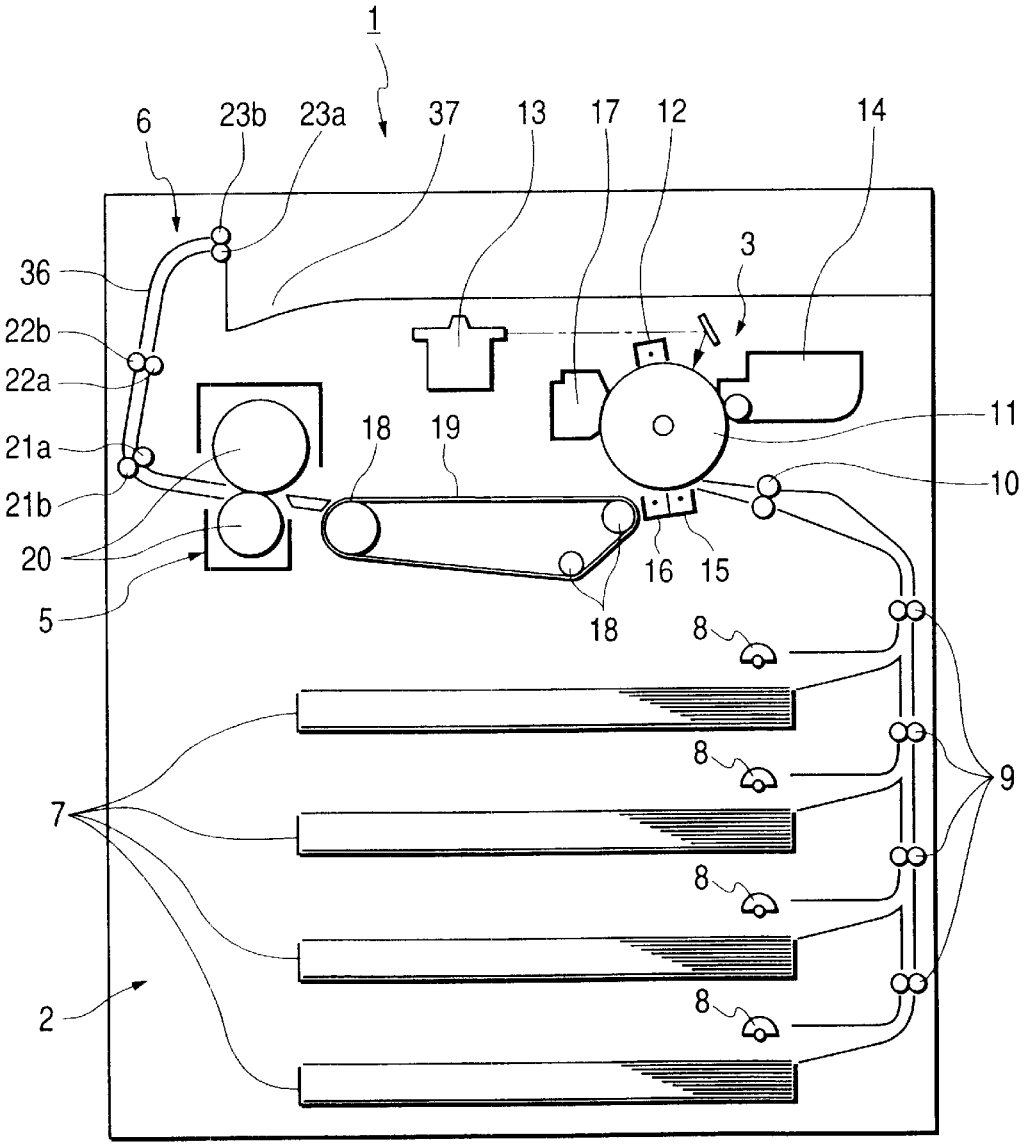
FIG. 1 is a view showing a structure of a plain model of an image forming apparatus according to the present embodiment.
Figure 2:
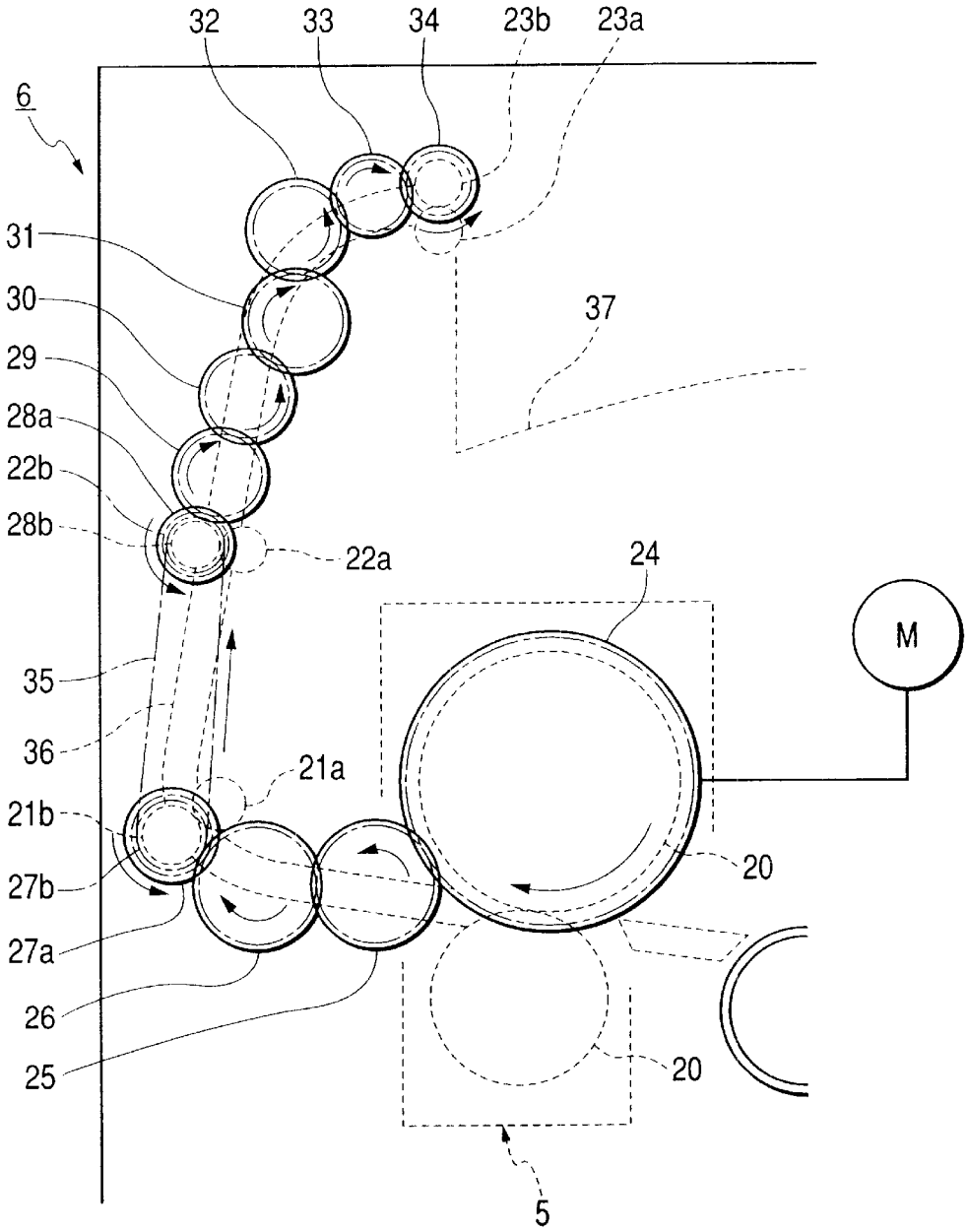
FIG. 2 is a view illustrating a sheet discharge portion.

First, the configuration and operation of this image forming apparatus will be outlined with reference to FIGS. 1 and 2. In an image forming apparatus body 1 arranged are a sheet feeding portion 2 for loading/storing sheets on which images are formed and for feeding the sheets to an image forming portion 3 one by one, the image forming portion 3 for forming images on each of the sheets, a sheet conveying portion 4 for conveying sheets on which images have been transferred, an image fixing portion 5 for fixing the images on the sheets almost indefinitely, a sheet discharge portion 6 for discharging the sheet on which images are fixed out of the apparatus, and a processing apparatus 46 for performing a certain processing on the image formed sheets. The configuration of each portion of the apparatus 1 will be described in detail below.

(Sheet Feeding Portion)

Sheet cassettes 7 for storing sheets P on which images are to be formed are arranged on the bottom side of the apparatus body 1. The sheets P are sent out from the sheet cassettes 7 by pickup rollers 8. And one sheet is separated from the sheets P having been sent out by separation means (for example, separation claws, separation pads and reversing rollers) not shown in the drawing. The separated sheet P is forced into a resist roller pair 10 provided near the entrance to the image forming portion 3 by means of sheet conveying roller pairs 9. Resist roller pair 10 fixes the position of the conveyed sheet P and conveys the same in such a manner that the conveyance is well timed in terms of the image forming operation.

(Image Forming Portion)

The image forming portion utilizing the electrographic method is provided with a laser scanner 13 for laser light irradiation on the basis of image data inputted to the apparatus, a photographic drum 11 as an image carrier, a primary electrically charging equipment 12 for uniformly charging the surface of the photographic drum 11, a developing equipment 14 for allowing an electrostatic latent image formed on the photographic drum 11 to be visible by sticking a toner thereon, a transfer charging equipment 15 for transferring the toner image formed on the photographic drum 11 to a sheet P, a separation charging equipment 16 for separating the sheet P have been subjected to the toner image transfer from the photographic drum 11 and cleaning equipment 17 for cleaning the drum 11 by removing the toner remaining thereon for the subsequent image formation.

(Sheet Conveying Portion)

The sheet conveying portion 4 located downstream in the sheet-conveying direction of the image forming portion 3 is provided with a conveying belt 19 engaging conveying rollers 18. This belt 19 is configured in such a manner that it can convey the sheet P while preserving the toner image transferred thereto.

(Image Fixing Portion)

In the image fixing portion 5, the toner image having been transferred to the sheet P is fixed thereon almost indefinitely in such a manner as to hold the sheet P between an image fixing roller pair 20 which has been heated with a heater (not shown in the drawing) and applying heat and pressure thereto so as to melt the toner. The sheet P having been subjected to image fixing is sent to the sheet discharge portion 6.

(Sheet discharge portion)

The sheet P having passed between the image fixing roller pair 20 is conveyed by conveying roller pairs 21 (21*a*, 21*b*) and 22 (22*a*,21*b*) through a conveying path 36 and discharged by a sheet discharge roller pair 23 (23*a*, 23*b*) into a sheet discharge tray 37 formed on an upper surface of the apparatus body 1. The apparatus of the plain model is provided with neither processing apparatus for performing processing on the sheet P nor double side unit for forming images on both sides of the sheet; therefore, the discharge roller pair 23 is allowed to always rotate in the direction as to discharge sheets into the sheet discharge tray 37.

It is a motor M, as first driving means, and multiple of gears and pulleys, as transmitting means for transmitting the drive of the motor M, which are arranged in series that drive each roller pair, as shown in FIG. 2.

The motor M, as the first driving means, drives the image fixing roller 20. A gear 24, as transmitting means, and the image fixing roller 20 are provided coaxially. The other transmitting means: a gear 25 meshing with the gear 24, a gear 26, and a gear 27*a* are arranged in series in sequence. The gear 27*a* and the conveyance roller 21*b* are coaxially arranged, and the rotation of the gear 27*a* allows the conveyance roller 21*b* to rotate in such a direction as to convey sheets to the sheet discharge tray 37.

The gear 27*a* and a pulley 27*b* are provided coaxially. The other pulley 28*b* and the conveying roller 22*b* are provided coaxially, and the pulleys 27*b* and 28*b* are connected with a timing belt 35. Thus, the rotation of the conveying roller 21*b* allows the conveying roller 22*b* to rotate at the same timing and in the same direction.

The pulley 28*b* and the gear 28*a* are provided coaxially, and the gear 28*a* transmits the rotation of the pulley 28*b* to a gear 29 with which the gear 28*a* meshes. With the gear 29 a gear 30 meshes, and a gear 31, gear 32, gear 33 and gear 34 mesh with each other in sequence, so as to constitute a gear bank.

A gear 34 and the sheet discharge roller 23*b* are provided coaxially. Thus, the discharge roller pair 23 is configured in such a manner as to be allowed to rotate in a direction that conveys sheets to the sheet discharge tray 37.

Figure 3:
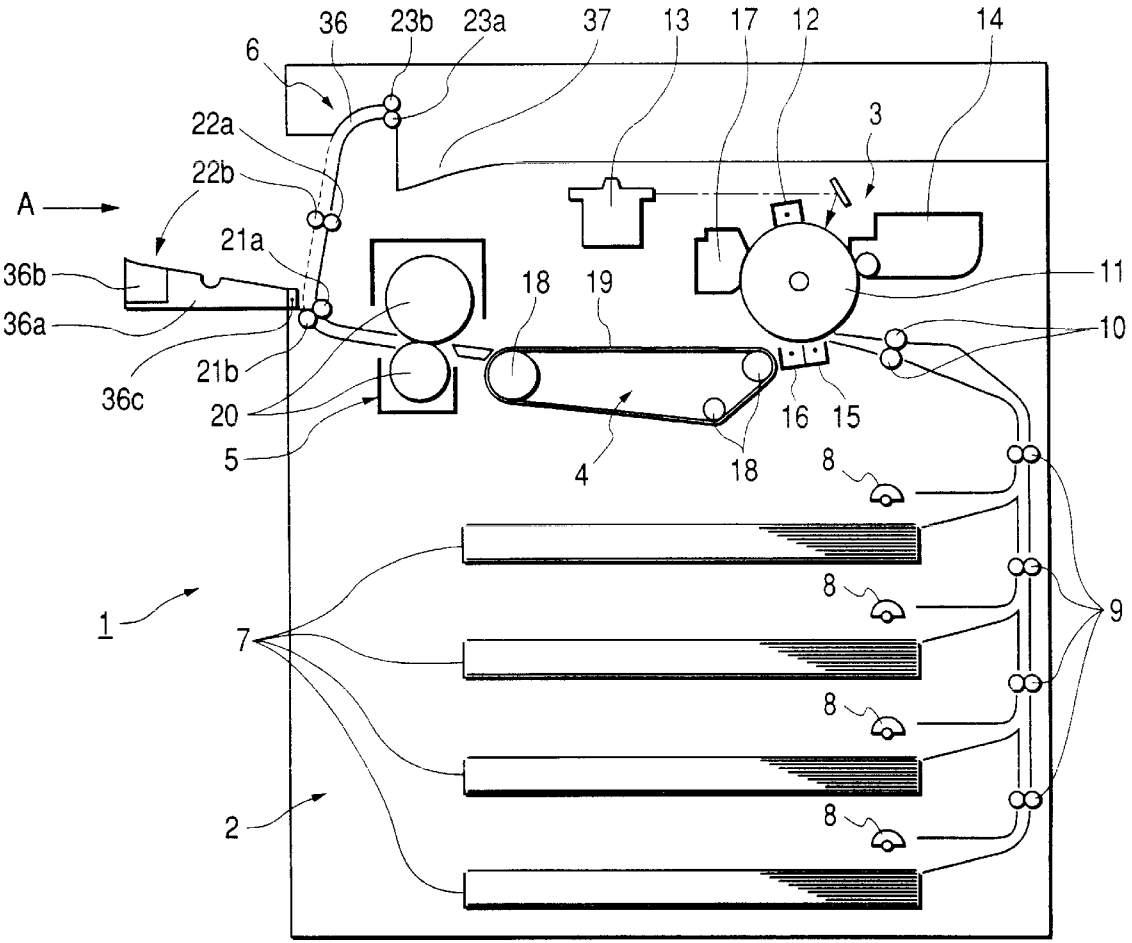
FIG. 3 is a view illustrating a state where a conveying path is opened.

The sheet discharge portion 6 is configured in such a manner that a sheet conveying path 36 can be opened by allowing the side portion of the image forming apparatus to pivot, as shown in FIG. 3. This makes easier the maintenance of the conveying path 36 jammed with sheets as well as of each roller.

Figure 4:
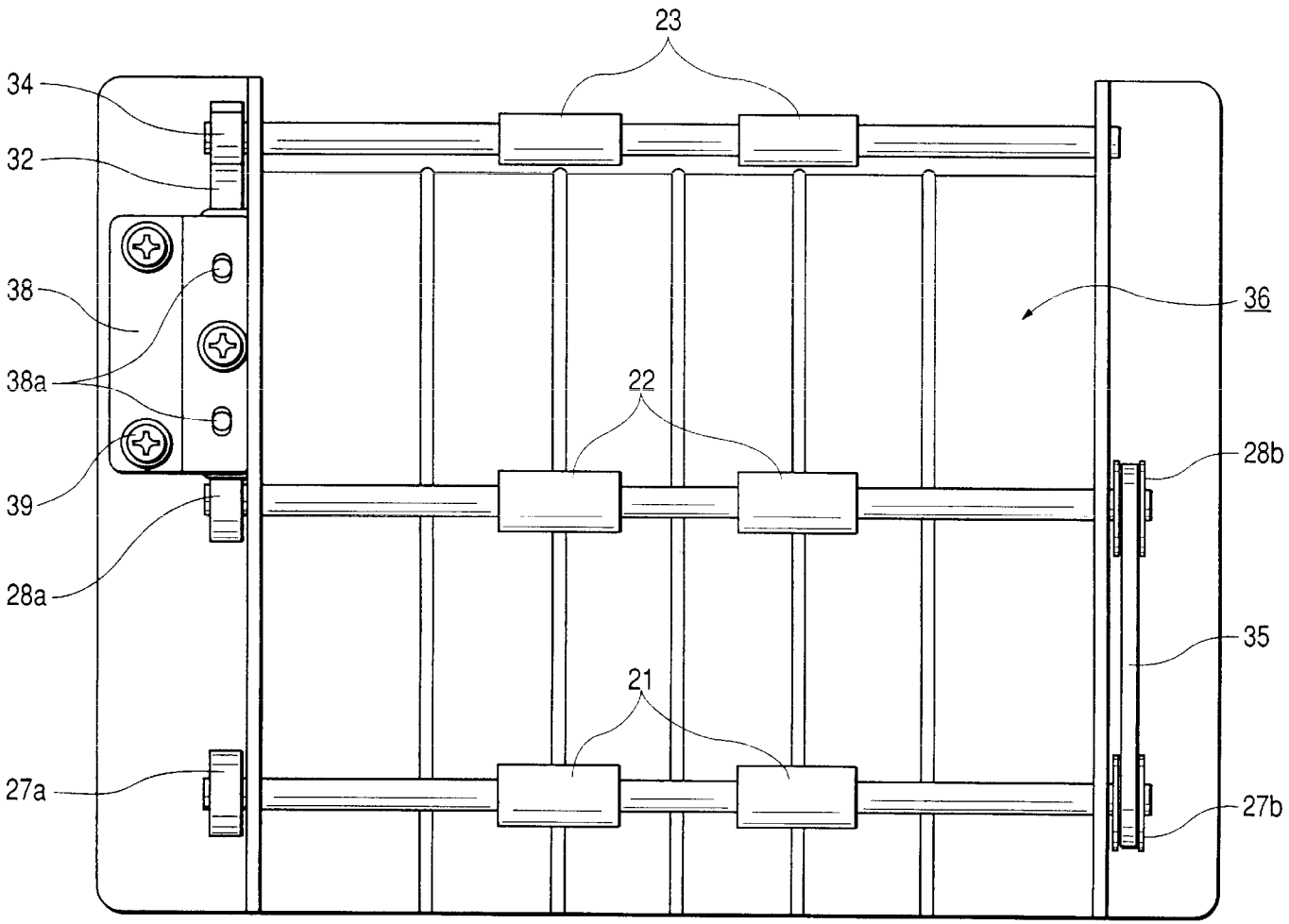
FIG. 4 is a view of FIG. 3 as seen from a direction denoted by an arrow A.
Figure 5:
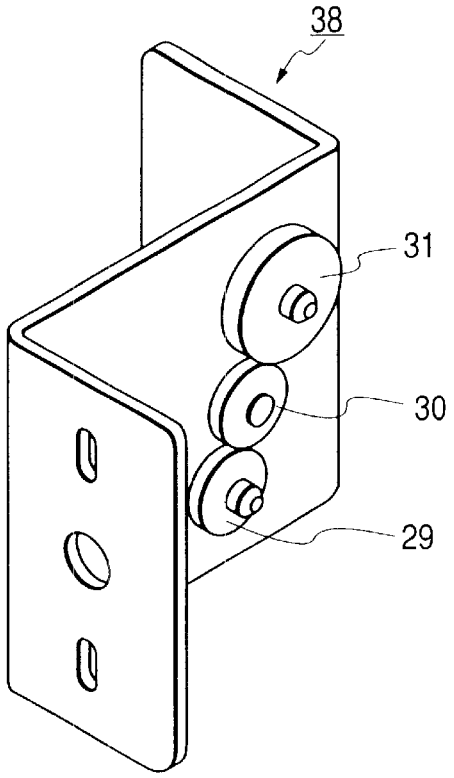
FIG. 5 is a perspective view of a gear unit.

FIG. 4 is a view of the image forming apparatus body 1 in a state where a pivot guide portion 36*a*, which allows the conveying path 36 to be opened, is allowed to pivot on the point 36*c*, as seen from the direction denoted by an arrow A in FIG. 3. In FIG. 4, there are arranged the above-described conveying rollers, pulleys, etc. Reference numeral 38 denotes a gear unit. The gear unit is also shown in FIG. 5. The gear unit is a zigzag member which is formed of the material having a relatively high strength, such as metal sheet, and has the gears 29, 30 and 31 of the above-described gear bank pivotably fitted thereto.

The gear unit 38 is fixed with screws 39 to the conveying path 36 at the location through which sheets do not pass in state that it meshes with the gears 28*a* and 32 of the gear bank. In other words, in the plain model printer, the gear unit 38 is previously fitted thereto and the gear unit 38 configures its transmitting means.

The main configuration of the printer set as a plain model is just as described above. Now the image forming operation of the printer having this configuration will be described briefly with reference to FIGS. 1 and 2.

One sheet is separated by the separation means not shown in the drawings from the sheets P sent out from the sheet cassettes 7 by the pickup rollers 8, then it is conveyed toward the image forming portion 3 by the conveying roller pairs 9.

The resist roller pair 10 fixes the position of the conveyed sheet P and stops the conveyance of the sheet P temporarily so that the conveyance will be well timed in terms of the image forming operation of the image forming portion 3. The sheet P having been subjected to correction of skew feed and timing in terms of the image forming operation of the image forming portion 3 by the resist roller pair 10 is then conveyed to the image forming portion 3 by the rotational motion of the resist roller pair 10.

While the above-described sheet conveying operation is progressing, the image forming operation is started at the image forming portion 3. At the time of starting the image forming operation, the surface of the photographic drum 11 is charged uniformly with the primary charging equipment 12. On the charged photographic drum 11, image data are written by the laser light irradiation of the laser scanner 13. Thus, an electrostatic latent image is formed on the photographic drum 11.

Then, the developing equipment 14 sticks a toner on the photographic drum 11 having an electrostatic latent image formed thereon, thereby a toner image to be transferred to a sheet is formed on the surface of the photographic drum 11.

The toner image having been formed on the photographic drum 11 is transferred to the sheet P which has been conveyed from the resist roller pair 10 and timed to synchronize with the image forming operation by the transfer charging equipment 15. And the operation for separating the sheet P and the photographic drum 11 is performed by the separation charging equipment 16 provided immediately behind the transfer charging equipment 15 downstream in the sheet conveying direction. The excess toner remaining on the surface of the photographic drum 11 is removed with the cleaning equipment 17 so as to allow the photographic drum 11 to provide for the subsequent image forming operation.

The sheet P separated from the photographic drum 11 by the separation charging equipment 16 of the image forming portion 3 is conveyed to the image fixing portion 5 by the conveying portion 4 provided downstream in the sheet conveying direction.

The toner image having been transferred to the sheet P is melted by the heat and pressure applied to the sheet P by the image fixing roller pair 20 provided to the image fixing portion 5 and fixed on the sheet P almost indefinitely.

The sheets P having the toner fixed thereon are conveyed through the conveying path 36 by the conveying roller pairs 21 and 22 and discharged into and stacked in the sheet discharge tray 37 with the side on which an image has been formed facing down by the sheet discharge roller pair 23. Since the sheets P are stacked with the side on which an image has been formed facing down, in the multiple page image formation with this printer, the image forming operation is started with the first page so that the sheets are not arranged in the wrong page order. The image forming operation of this image forming apparatus is as described above.

There are considered to be cases where the uses request that processing apparatus such as stapler and options such as double side unit be added to the printers they bought. In other words, there arises the need to expand the plain model image forming apparatus having already been installed into the option model one.

Now, the expansion of the plain model image forming apparatus into the option model one, which is the major characteristic of the present invention, will be described. In this embodiment, a processing apparatus 46, as an option to be added to a printer, is a stapling apparatus which ties sheets in bundles and performs stapling processing on the bundles (refer to FIG. 11). Since the configuration of a stapling apparatus is a well-known art, its description will be omitted.

Although the present invention is described in terms of its preferred embodiment, it is not intended to be limited to the specific processing type of processing apparatus, but applicable to any type of processing apparatus such as sorting apparatus for sorting sheets into bundles, stamping apparatus for stamping sheets, and punching apparatus for punching a hole in sheets (punching processing). Further, if the sheets having been subjected to processing in the processing apparatus 46 are conveyed again to the image forming apparatus 1, the processing apparatus 46 is allowed to be a double side unit for forming images on both sides of the sheets.

At the time of conveying the sheets P, which have been subjected to image formation, to the processing apparatus 46, care should be taken not to arrange the sheets in the wrong page order. Thus, in recent years, a method has been devised in which part of the sheet having been subjected to image formation are once discharged into the sheet discharge tray and these sheets are conveyed to the processing apparatus by rotating the sheet discharge roller pair in the reverse direction at just a predetermined time.

However, when the plain model printer is expanded into an option model one, in order to convey sheets to the processing apparatus 46 by the above-described operation, the sheet discharge roller pair 23 needs to be configured in such a manner as to be allowed to rotate in both the forward and the backward directions. In the plain model printer, the rotational driving of each roller pair is performed by the transmitting means arranged in series from the image fixing portion 5; accordingly, in order to rotate the sheet discharge roller pair 23 in the direction opposite to the sheet discharge direction, the motor M which drives the image fixing portion 5 needs to be rotated in the reverse order.

In the image fixing roller pair 20, taking into account its special configuration, wear, etc., it is not realistic to rotate it in the direction opposite to the sheet conveying direction. Even if the image fixing roller pair is rotated in the reverse direction, the image fixing operation cannot be performed on the sheet during its rotation in the reverse direction, which may result in decrease in throughput.

In such a situation, a method has been proposed, as disclosed in the section of "Related Background Art", in which a unit including the sheet discharge roller pair 23 is replaced with an expansion unit used exclusively as a processing apparatus. However, this method gives rise to problems of increasing costs, etc., as described above.

In light of the above problems, in the present invention, the printer is configured in such a manner that part of the gear bank of the plain model printer is formed as a unit as describe above and the gear unit 38 is replaced with a motor unit 40 as second driving means. This configuration does not require any large-scale unit replacement which the prior art have done and enables the expansion of printer regardless of its simplicity. The configuration of the unit 40 and the method of expanding the printer will be described below.

Figure 7:
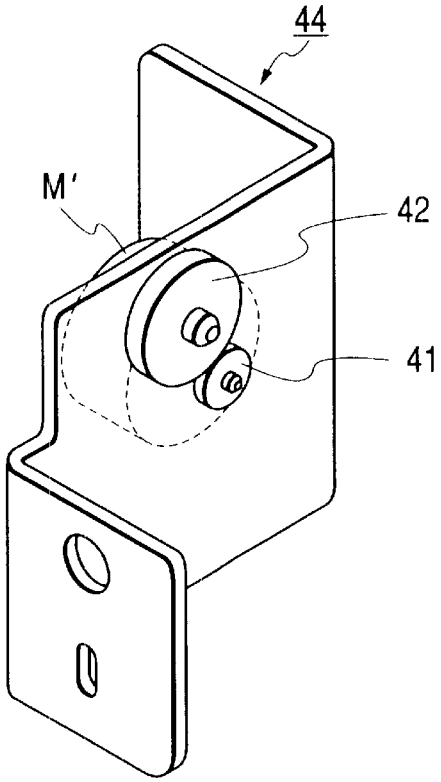
FIG. 7 is a perspective view of a motor unit.

As shown in FIGS. 4 and 5, the gear unit 38 is a unit comprising part of the gear bank configured in series from the motor M toward the sheet discharge roller pair 23. The motor unit 40 is almost the same as the gear unit 38 in size and shape and has a motor M' capable of rotating in both the forward and the backward directions, as shown in FIG. 7. It also has gears 41 and 42 which are rotated by the drive of the motor M'.

Figure 6:
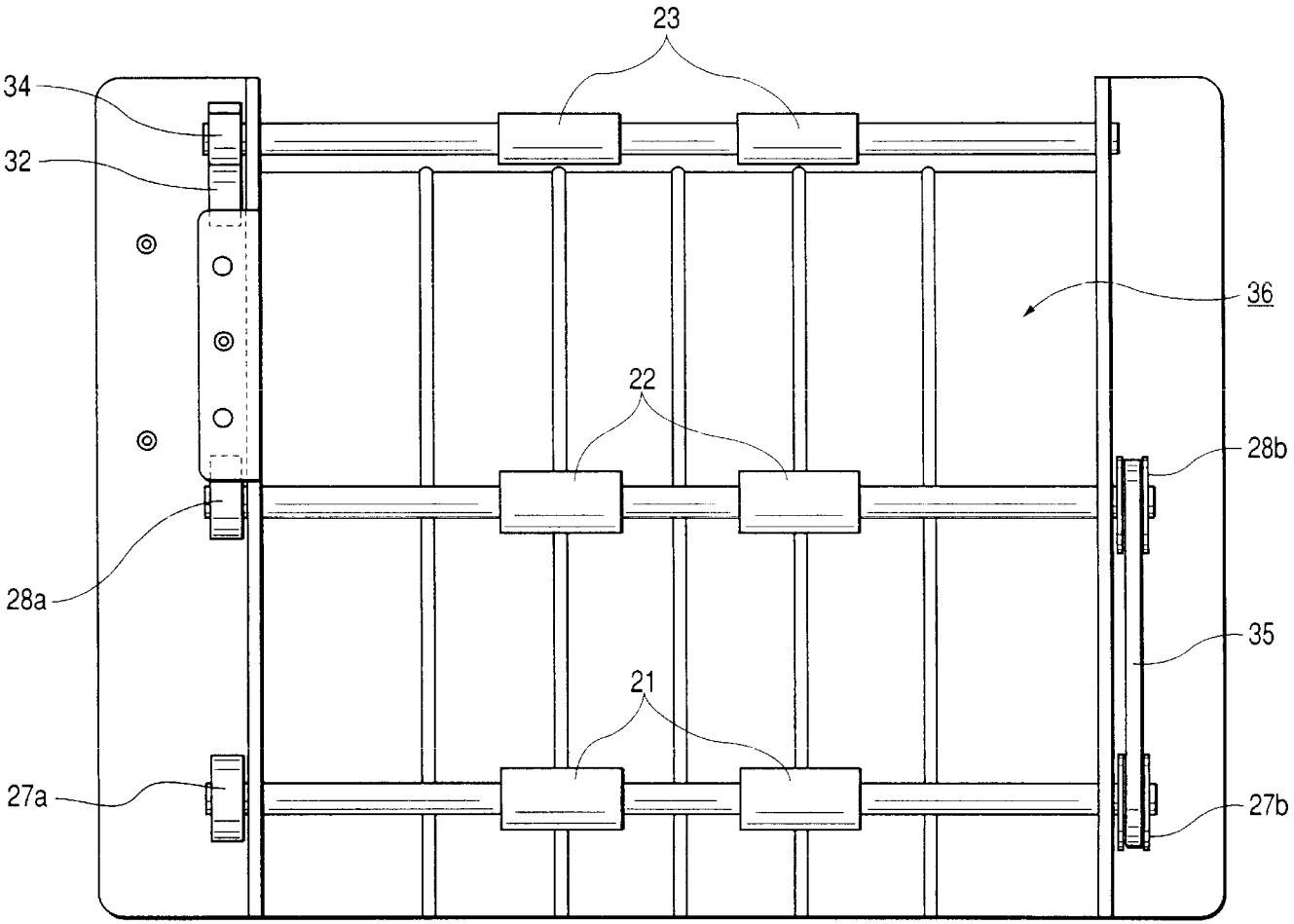
FIG. 6 is a view of the conveying path of FIG. 4 illustrating a state where a gear unit is removed.
Figure 8:
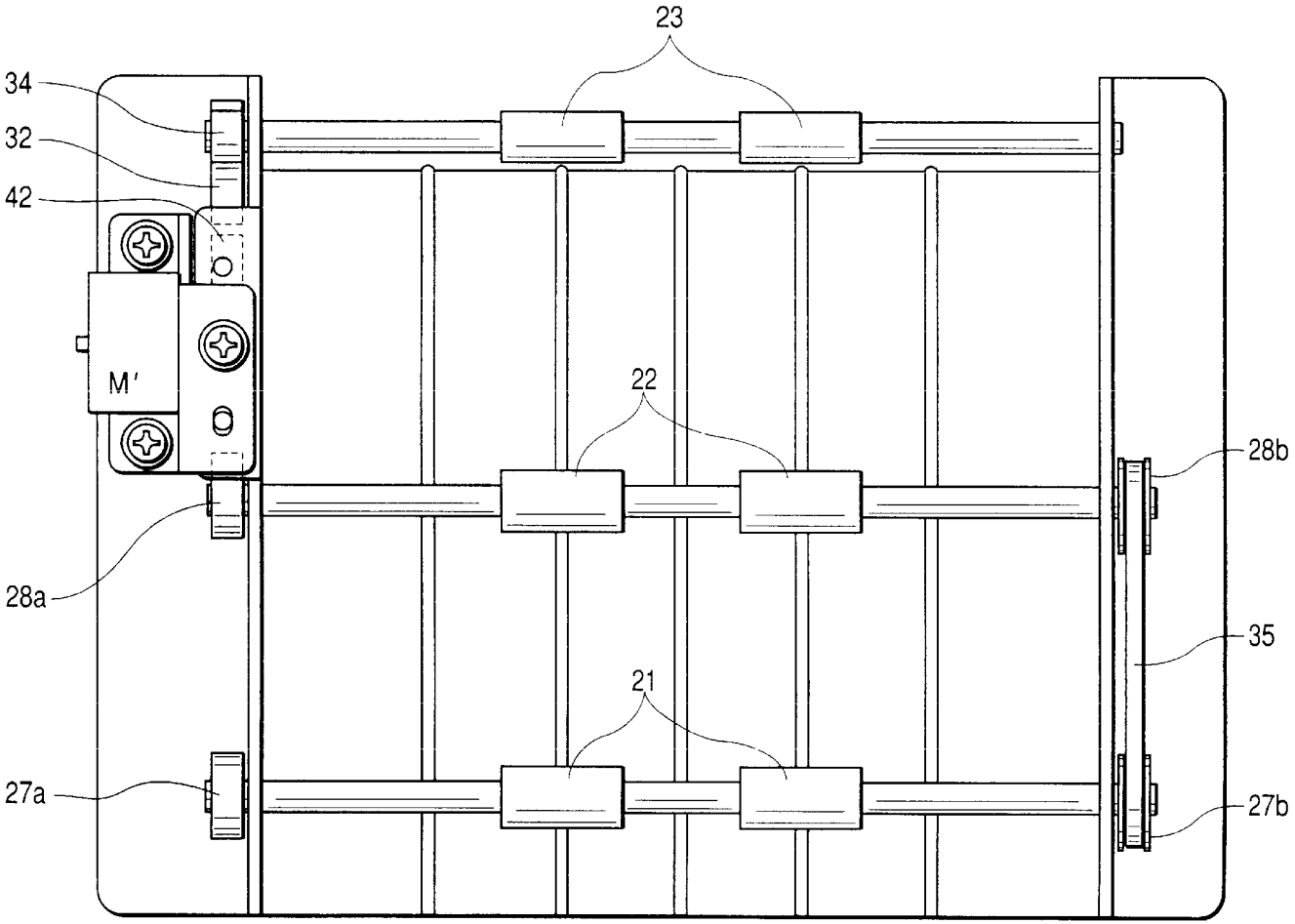
FIG. 8 is a view of the conveying path of FIG. 6 illustrating a state where a motor unit is fitted thereto.

The motor unit 40 is located at the portion from which the gear unit 38 has been removed in such a manner that its gear 42 meshes the gear 32 of the gear bank formed in the printer body 1 and it is fitted to the printer body 1 by fixing means such as screw 39, as shown in FIGS. 6 and 8. In regard to the location, both the motor unit 40 and the gear unit 38 require the accuracy of gearing; accordingly, each unit is configured in such a manner that it can be easily located upward and downward with slotted holes 38*a*.

In order to convey the sheets P to the processing apparatus 46 provided at the side portion of the printer body 1 by rotating the sheet discharge roller pair 23 in the reverse direction, a sheet conveying path is needed which connects the printer body 1 and the processing apparatus 46. The apparatus of the present invention, therefore, is configured in such a manner that part of its pivot guide 36*a* can be replaced with a path unit 44 at the time of altering it from the plain model printer to the option model one (refer to FIG. 9).

Figure 9:
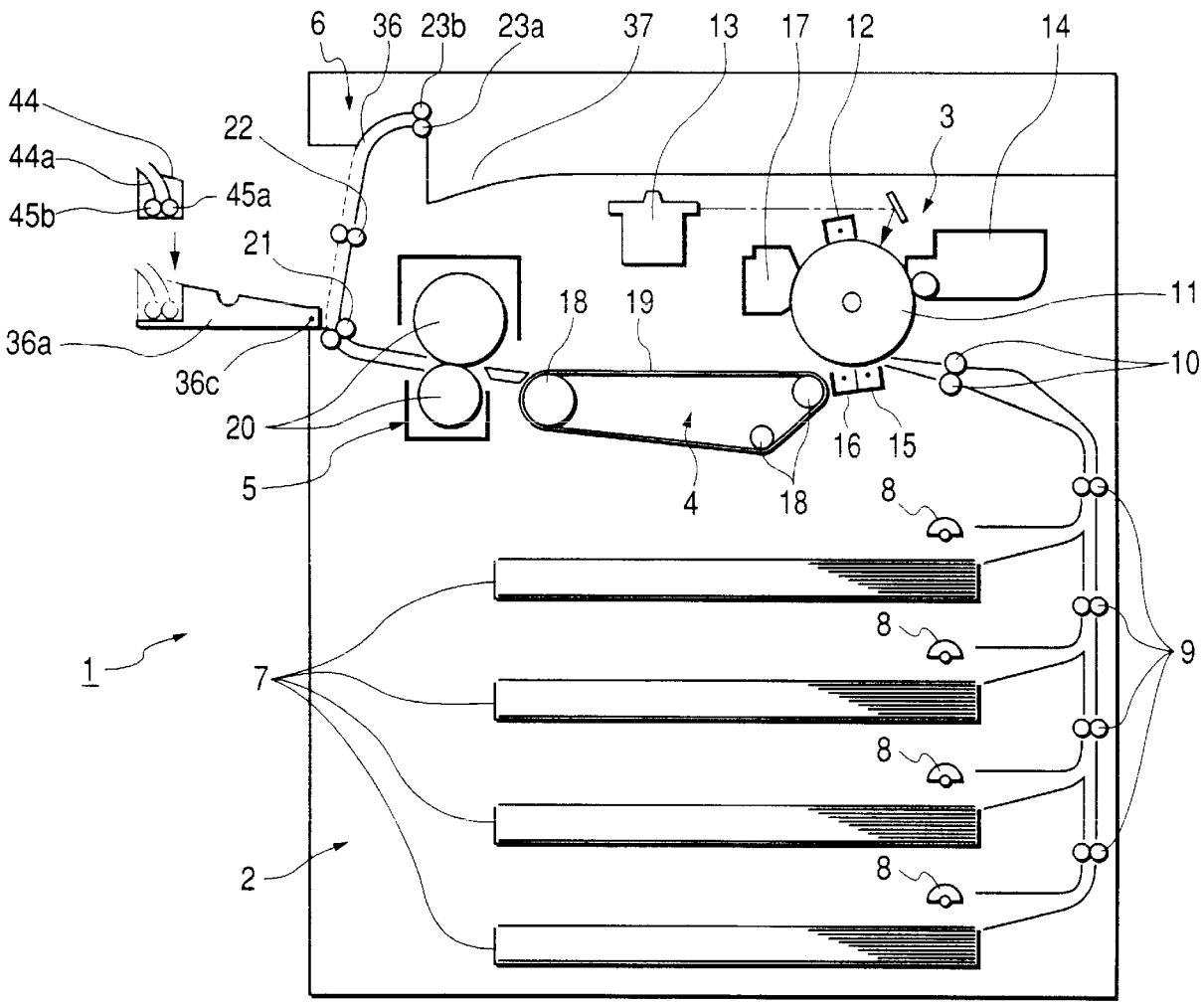
FIG. 9 is a view illustrating path unit replacement.

As show in FIG. 9, the path unit 44 forms a second conveying path 44*a* for conveying the sheets P having been conveyed in the reverse direction by the sheet discharge roller pair 23 to the processing apparatus 46, when it is fitted to the printer body 1 at the unit fitting position 36*b* of the pivot guide 36*a*.

The path unit 44 has a second sheet discharge roller pair 45 (45*a*, 45*b*) which are allowed to rotate when the gear 42 provided in the motor unit 40 meshes the gear 43 provided coaxially with the sheet discharge roller pair 45*b*. The gears 43 and 42 are configured in such a manner as to mesh with each other when the pivot guide 36*a* is closed.

Figure 10:
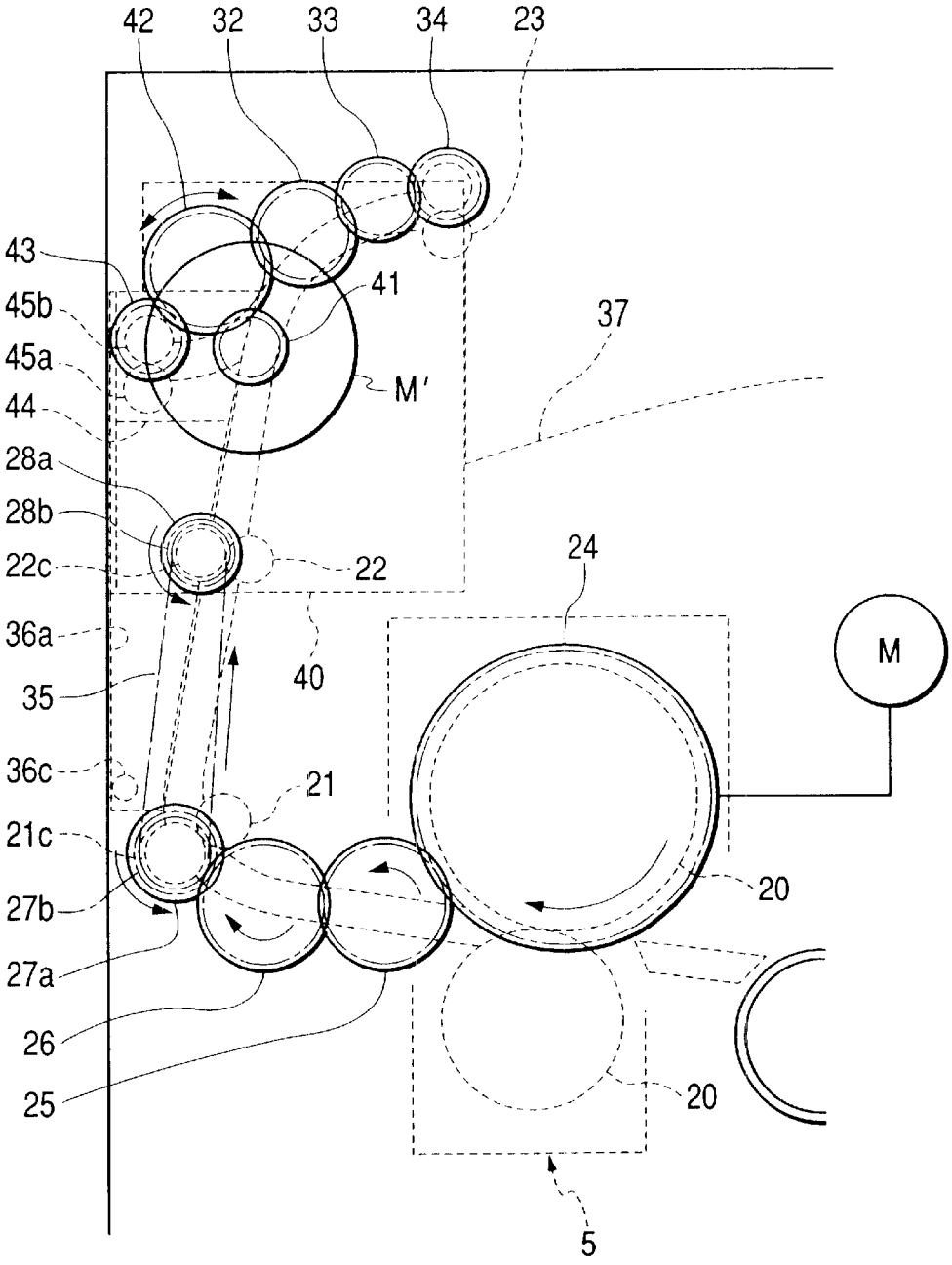
FIG. 10 is a view of a sheet discharge portion illustrating a state where a motor unit and a path unit are fitted thereto.

As shown in FIG. 10, in state where the pivot guide 36*a* is closed, when the sheet discharge roller pair 23 is rotated in the reverse direction (in such a direction as to convey the sheets P to the processing apparatus), the second sheet discharge roller pair 45 is also allowed to rotate in the same direction.

Then, the method of altering the plain model printer into the option model printer based on the unit replacement will be described.

In the plain model printer, the conveying path 36 can be exposed at the time of allowing the pivot guide 36*a* to pivot, as shown in FIG. 3. In this state, the gear unit 38 is removed from the printer body 1 and the motor unit 40 is fitted thereto. The drive of the motor M' of the motor unit 40 is controlled by controlling means not shown in the drawings and its ON/OFF and forward/backward rotation are freely performed according to the directions from the controlling means. Thus, the rotation of the sheet discharge roller pair 23 can be operated appropriately and freely in such a direction as to discharge sheets to the sheet discharge tray 37 and in the direction opposite thereto independent of the driving of the motor M.

Then the path unit 44 is fitted to the printer body at the unit fitting position 36*b* of the pivot guide 36*a*. The printer is configured in such a manner that the path unit 44 can be easily fitted thereto if only it is fitted to the unit fitting position.

After fitting the motor unit 40 and the path unit 44 to the printing apparatus body 1, the pivot guide 36*a* is closed and the processing apparatus 46 is fitted to a predetermined position at which it can receive sheets P from the second sheet discharge roller pair 45. The option model printer can be thus configured.

As described above in detail, the expansion of a printer is performed while allowing the configuration of the printer to be simple, as compared with the prior art method in which the plain model printer is expanded to an option model one by replacing its sheet discharge unit including sheet discharge roller pair with a predetermined unit. This enables the reduction in apparatus costs and provides a simpler method of expanding a printer.

Figure 11:
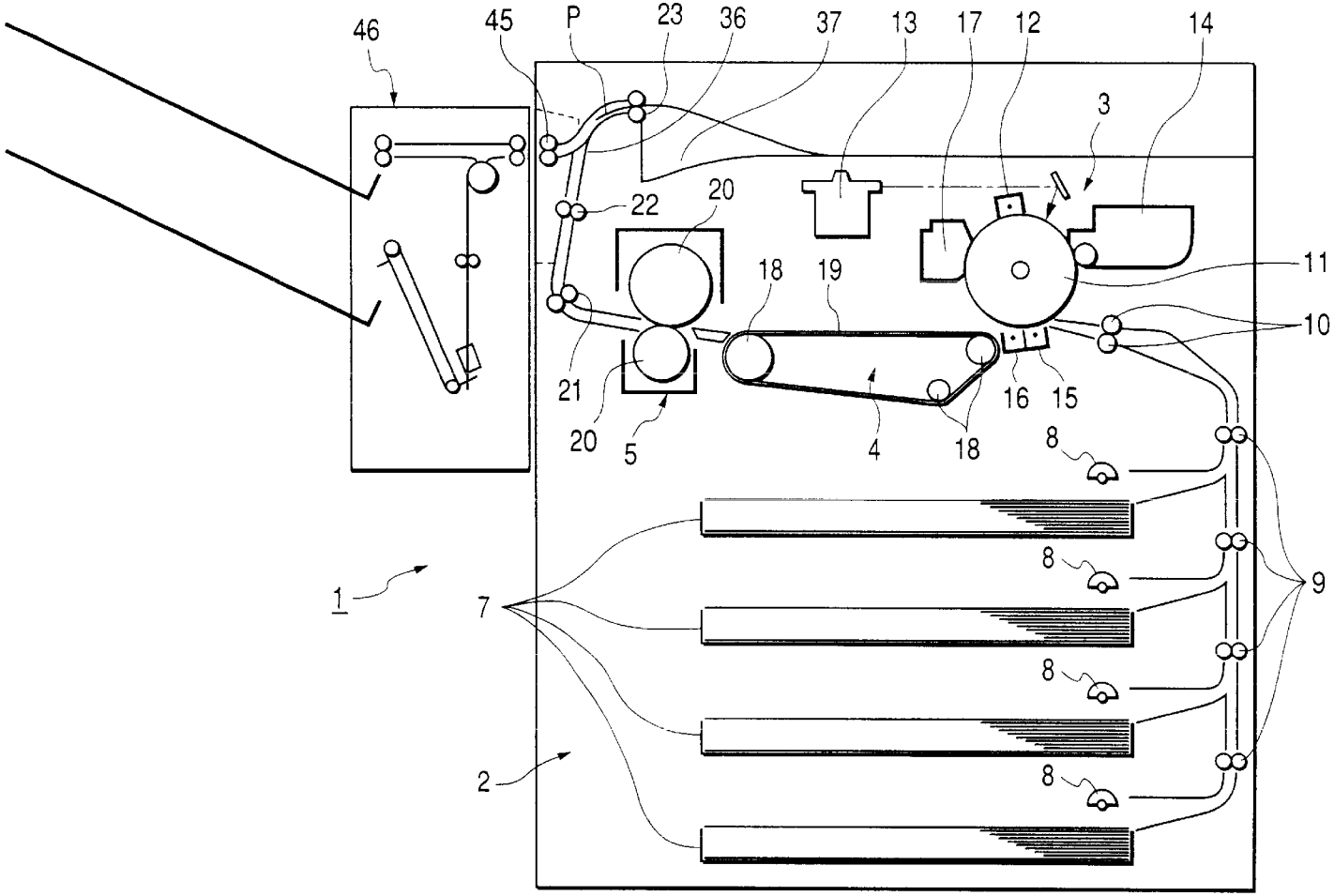
FIG. 11 is a view showing a structure of an option model image forming apparatus in a state where a processing apparatus is fitted thereto.
Figure 12A:
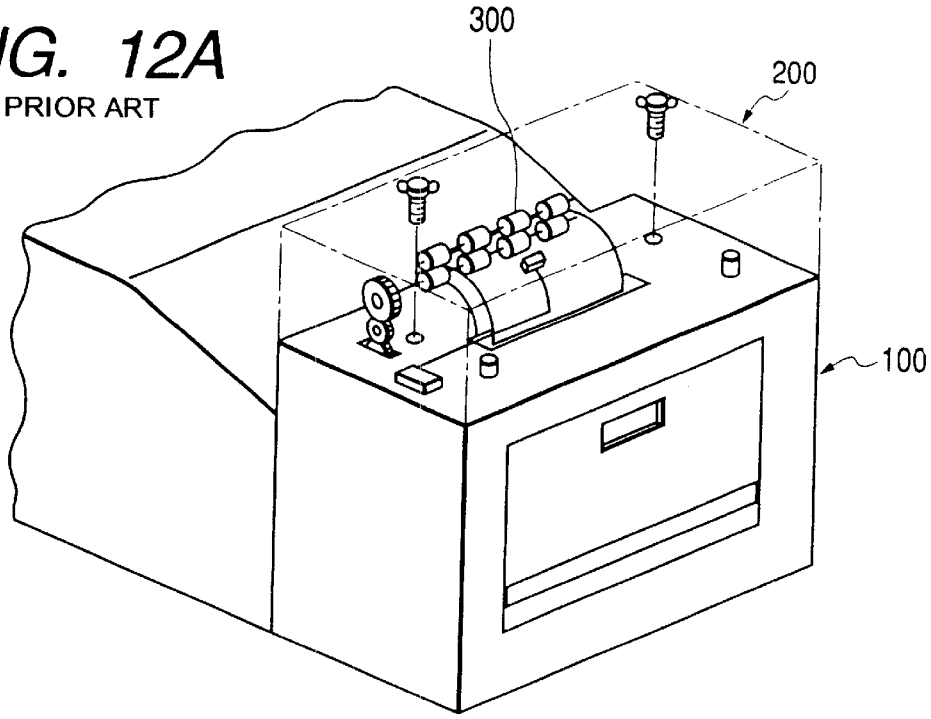
FIG. 12A PRIOR ART
FIG. 12A and FIG. 12B are views showing a sheet discharge unit of an image forming apparatus according to the prior art.
Figure 12B:
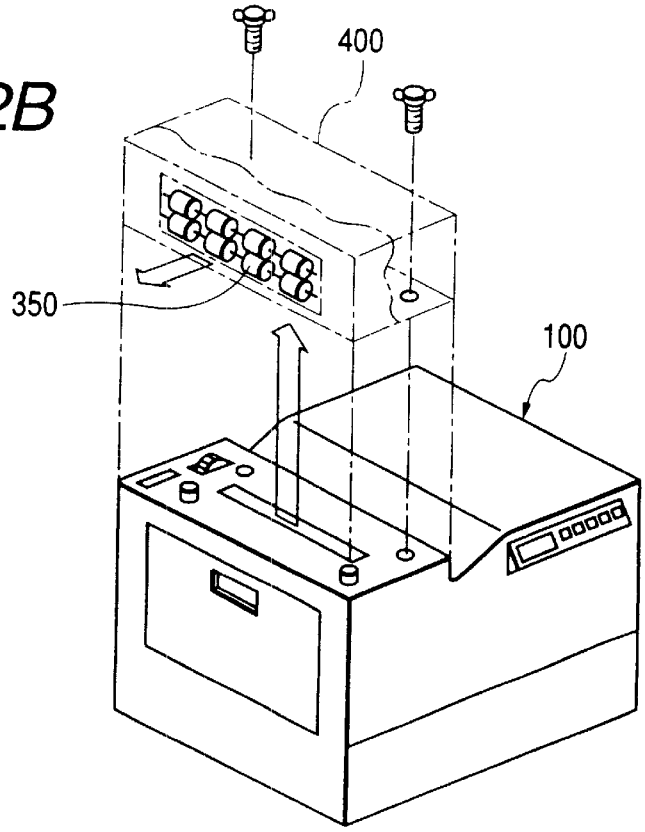
FIG. 12B PRIOR ART

Now the image forming operation of the option model printer will be described with reference to FIGS. 10 and 11. The operation until the toner image is fixed on the sheet is the same as that of the plain model printer; therefore, its description will be omitted here.

The sheet P having passed through the image fixing portion 5 is conveyed toward the sheet discharge roller pair 23 by the conveying roller pairs 21 and 22. At this time, the sheet discharge roller pair is being rotated by the drive of the motor M' in such a direction as to discharge the sheet P into the sheet discharge tray 37.

The sheet P starts to be discharged into the sheet discharge tray 37 while it is held between the sheet discharge roller pair 23. At the time when the proximal end of the sheet has passed through the portion where the conveying path 36 joins the second conveying path 44*a* formed by the path unit 44, the motor M' is allowed to stop its rotational motion (forward rotation) by the control of the controlling means not shown in the drawing and starts to rotate in such a direction as to put the sheet P back into the printing apparatus (backward rotation).

At this time, the proximal end of the sheet (the end portion remaining in the printing apparatus) is introduced into the second conveying path 44*a* by the action of a flapper (not shown in the drawing) which is provided at the portion where the conveying path 36 and the second conveying path 44*a* are joined alters the conveying direction of the sheet P. The flapper is provided in the path unit 44 and configured in such a manner that it is displaced according to the changes in direction in which the motor M' is rotated.

The sheet P introduced into the second conveying path 44*a* is held between the second sheet discharge roller pair 45 and conveyed into the processing apparatus 46 fitted to the printer. When the proximal end (the rear end relative to the direction in which the sheet P is conveying) of the sheet P has passed through the nip portion of the second sheet discharge roller pair 45, the motor M' stops driving and enters in a stand-by state for the subsequent operation. Then, the sheet P having images formed thereon is conveyed into the processing apparatus 46 in order of page number, subjected to a predetermined processing (stapling processing in this embodiment), and discharged into the tray provided in the processing apparatus 46.

It is apparent from the above description that even if any changes can be added to the option model printer, the plain model printer needs not to be equipped with the second sheet discharge roller pair 45, the second conveying path 44*a*, etc. which are used only when the option model printer has option apparatus fitted thereto. Thus cost reduction and space saving are realized in the plain model printer.

As the motor M' for use in the motor unit 40 of the present invention suitably used is a stepping motor of which rotational direction and rotational speed can be freely controlled according to the input of pulse signals.

In the present invention, the path unit and the motor unit are independently provided and the expansion to the option model printer is performed by the replacement of each unit, however, when these unit are configured and provided as an integral unit so as to expand the plain model printer to the option model one, the object of the present invention can be attained. And the conveying path may be previously provided in the image forming apparatus body 1 not as a unit.

Furthermore, in this embodiment, the image forming apparatus body is configured in such a manner that it side portion is allowed to pivot, and the unit replacement is performed while allowing the side portion to pivot; however, the present invention is not intended to be limited to this configuration, but applicable to the configuration in which unit replacement can be performed from the front side of the apparatus.

As described above, according to the present invention, the plain model image forming apparatus can be altered into the option model image forming apparatus having the processing apparatus fitted thereto by replacing part of the first driving means for driving the first sheet discharge roller pair with the second driving means and by replacing part of the openable and removable portion of the first sheet discharge path with the connecting discharge means. According to the present invention, even if any changes can be added to the option model printer, the plain model printer needs not to be equipped with the second sheet discharge path and the second sheet discharge roller pair, which can realize the cost reduction and space saving in the plain model printer.

What is claimed is:

1. A sheet conveying apparatus, comprising:

a roller to which torque in a direction is transmitted; and transmitting means for transmitting the torque to the roller, wherein the transmitting means is replaceable by driving means capable of freely rotating said roller in both forward and backward directions, and wherein the transmitting means is replaceable without removing the roller from the sheet conveying apparatus.

2. The sheet conveying apparatus according to claim 1, wherein each of said driving means and said transmitting means comprises an integrally formed unit and is removably attached to the sheet conveying apparatus.

3. The sheet conveying apparatus according to claim 1, wherein said roller is a discharge roller for discharging sheets out from the apparatus and said driving means replaceable by said transmitting means is capable of rotating said discharge roller in such a direction as to discharge sheets out from the apparatus as well as in an opposite direction to which the sheets are discharged.

4. A sheet conveying apparatus, comprising:

a roller to which torque in a direction is transmitted; and transmitting means for transmitting the torque to said roller, wherein said transmitting means is replaceable by driving means capable of freely rotating said roller in both forward and backward directions, and wherein the replacement of said transmitting means by the driving means is made possible by opening an exterior of the sheet conveying apparatus.

5. An image forming apparatus comprising image forming means for forming images on the sheets conveyed by the sheet conveying apparatus according to any one of claims 1 to 4.

6. A sheet conveying apparatus, comprising:

a roller for conveying sheets;

first driving means for generating torque which allows said roller to rotate in a fixed direction; and transmitting means for transmitting a torque generated by said first driving means to said roller, wherein said transmitting means is replaceable by a second driving means capable of rotating the roller, and wherein said transmitting means is replaceable without removing the roller from the sheet conveying apparatus.

7. The sheet conveying apparatus according to claim 6, wherein each of said transmitting means and said second driving means comprises an integrally formed unit and is removably attached to the sheet conveying apparatus.

8. The sheet conveying apparatus according to claim 6, wherein said roller is a discharge roller for discharging sheets from the apparatus and said transmitting means is formed in such a manner as to rotate said discharge roller in a direction that the sheets are discharged from the apparatus by the torque transmitted from said first driving means, said second driving means replaceable with said transmitting means is capable of rotating the discharge roller in such a direction as to discharge the sheets from the apparatus as well as in an opposite direction to which the sheets are discharged.

9. A sheet conveying apparatus, comprising:

a roller for conveying sheets;

first driving means for generating torque which allows said roller to rotate in a fixed direction; and transmitting means for transmitting a torque generated by said first driving means to said roller, wherein said transmitting means is replaceable by a second driving means capable of rotating said roller, and wherein the replacement of said transmitting means by said second driving means is made possible by opening an exterior of the sheet conveying apparatus.

10. The sheet conveying apparatus according to claim 6, wherein said second driving means is a stepping motor capable of rotating in both forward and backward directions according to an input of pulse signals.

11. The sheet conveying apparatus according to claim 6, further comprising a conveying path which guides the conveyed sheets in the opposite direction.

12. The sheet conveying apparatus according to claim 11, wherein the conveying path is formed as a unit and can be fitted to the apparatus when replacing said transmitting means with said second driving means.

13. The sheet conveying apparatus according to claim 11, wherein the conveying path is formed integrally with said second driving means.

14. The sheet conveying apparatus according to claim 11, wherein the sheets having been guided by the conveying path are conveyed to a processing apparatus where a predetermined processing is performed.

15. An image forming apparatus comprising image forming means for forming images on sheets conveyed by the sheet conveying apparatus according to any one of claims 6 to 14.

16. An image forming apparatus, comprising:

an apparatus frame body;

discharge rollers which are provided in said apparatus frame body and discharge sheets out from said apparatus frame body;

driving means for driving said discharge rollers in such a direction as to discharge the sheets out from said apparatus frame body; and transmitting means for transmitting a driving force generated by said driving means to the discharge rollers, wherein said discharge rollers can rotate in both forward and backward directions and said transmitting means is removable from said apparatus frame body without removing said discharge rollers from said apparatus frame body.

17. A sheet conveying apparatus, comprising:

a roller for conveying a sheet; and a gear bank for transmitting the drive force to said roller, with said gear bank including a gear unit, wherein said gear unit is replaceable by a motor unit having a motor without removing said roller from the sheet conveying apparatus, and when said gear unit is replaced by said motor unit, said motor can rotate said roller in both forward and backward directions.

18. A sheet conveying apparatus according to claim 17, wherein each of said gear unit and said motor unit is an integrally formed unit and is removably attached to the sheet conveying apparatus.

19. A sheet conveying apparatus according to claim 17, wherein said roller is a discharge roller for discharging sheets from the sheet conveying apparatus, and when said motor unit is attached to the sheet conveying apparatus said motor can rotate said roller in such a direction as to discharge the sheet out from the sheet conveying apparatus as well as in an opposite direction to which the sheets are discharged.

20. A sheet conveying apparatus according to claim 17, wherein a path unit having a conveying path and a second roller can be attached to the sheet conveying apparatus, and when said motor unit and said path unit can be attached to the sheet feeding apparatus, a sheet conveyed by said roller in the backward direction is guided by the conveying path and conveyed by said second roller.

21. A sheet conveying apparatus according to claim 20, wherein said second roller is rotated by said motor of said motor unit when said motor unit and said path unit are attached to the sheet conveying apparatus.

22. A sheet conveying apparatus according to claim 21, wherein said roller is a first discharge roller for discharging sheets from one side of the sheet conveying apparatus, and said second roller is a second discharge roller for discharging sheets from a second side of the sheet conveying apparatus, and when said motor unit and said path unit are attached to the sheet conveying apparatus said motor can rotate said first discharge roller in the forward direction to discharge the sheet out from one side of the sheet conveying apparatus, and said motor can rotate said first discharge roller and second discharge roller in the backward direction to discharge the sheet out from the second side of the sheet conveying apparatus.

* * * * *

UNITED STATES PATENT AND TRADEMARK OFFICE

CERTIFICATE OF CORRECTION

PATENT NO. : 6,473,579 B1
DATED : October 29, 2002
INVENTOR(S) : Kenji Suzuki et al.

It is certified that error appears in the above-identified patent and that said Letters Patent is hereby corrected as shown below:

Column 1,
Line 29, "side" should read -- sided --.

Column 2,
Line 47, "side" should read -- sided --.
Line 50, "electrographic" should read -- electrophotoraphic --.

Column 3,
Line 19, "electrographic" should read -- electrophotographic --.
Line 30, "have" should read -- having --.
Line 58, "side" should read -- sided --.
Line 60, "as" should read -- so as --.

Column 4,
Line 43, "state that" should read -- a state where --.

Column 5,
Line 44, "uses request" should read -- users request --.
Line 46, "side" should read -- sided --.

Column 6,
Line 2, "side" should read -- sided --.

Column 7,
Line 18, "state" should read -- a state --.
Line 33, "rotation" should read -- rotations --.

Column 8,
Line 26 "conveying)" should read -- conveyed) --.
Line 37, "needs not" should read -- does not need --.
Line 55, "it" should read -- its --.

UNITED STATES PATENT AND TRADEMARK OFFICE

CERTIFICATE OF CORRECTION

PATENT NO. : 6,473,579 B1
DATED : October 29, 2002
INVENTOR(S) : Kenji Suzuki et al.

It is certified that error appears in the above-identified patent and that said Letters Patent is hereby corrected as shown below:

Column 9,
Line 4, "needs not" should read -- does not need --.

Signed and Sealed this

Tenth Day of June, 2003

JAMES E. ROGAN
*Director of the United States Patent and Trademark Office*